United States Patent [19]

Marsden

[11] 4,314,518

[45] Feb. 9, 1982

[54] SIMPLIFIED SAILING SYSTEM

[75] Inventor: Floyd Marsden, Garden City, Ga.

[73] Assignee: Barbara B. Marsden, Garden City, Ga.

[21] Appl. No.: 125,360

[22] Filed: Feb. 27, 1980

[51] Int. Cl.[3] ..... G01D 21/00

[52] U.S. Cl. ..... 114/39; 114/144 C

[58] Field of Search ..... 114/39, 90, 93, 102, 114/103, 144 C, 270; 116/28 R, 200, 265; 73/188

[56] References Cited

U.S. PATENT DOCUMENTS

| | | | |
|---|---|---|---|
| 2,147,501 | 2/1939 | Ryder | 114/102 |
| 3,371,529 | 3/1968 | Tillman | 73/188 |
| 3,478,585 | 11/1969 | Scannell | 73/188 |
| 3,641,815 | 2/1972 | Fassett | 73/188 |
| 3,845,734 | 11/1974 | Demos | 116/200 |
| 3,889,620 | 6/1975 | Dorland | 114/39 |

FOREIGN PATENT DOCUMENTS

| | | | |
|---|---|---|---|
| 1953852 | 10/1969 | Fed. Rep. of Germany | 114/39 |

*Primary Examiner*—Frank Sever

*Attorney, Agent, or Firm*—Larry Harold Kline

[57] ABSTRACT

A method and device are disclosed for sailing a wind-propelled vehicle whereby when a rig positioning indicator identifies the same portion of an identifiable code on a second coded structure that a wind indicator identifies on a first coded structure, the sails of the wind-propelled vehicle are in the appropriate position for that particular wind direction.

16 Claims, 20 Drawing Figures

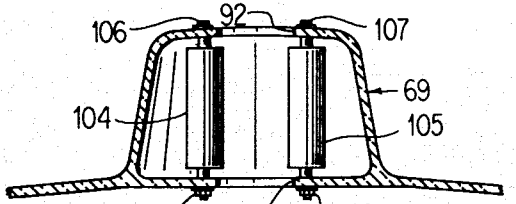
FIG. 12
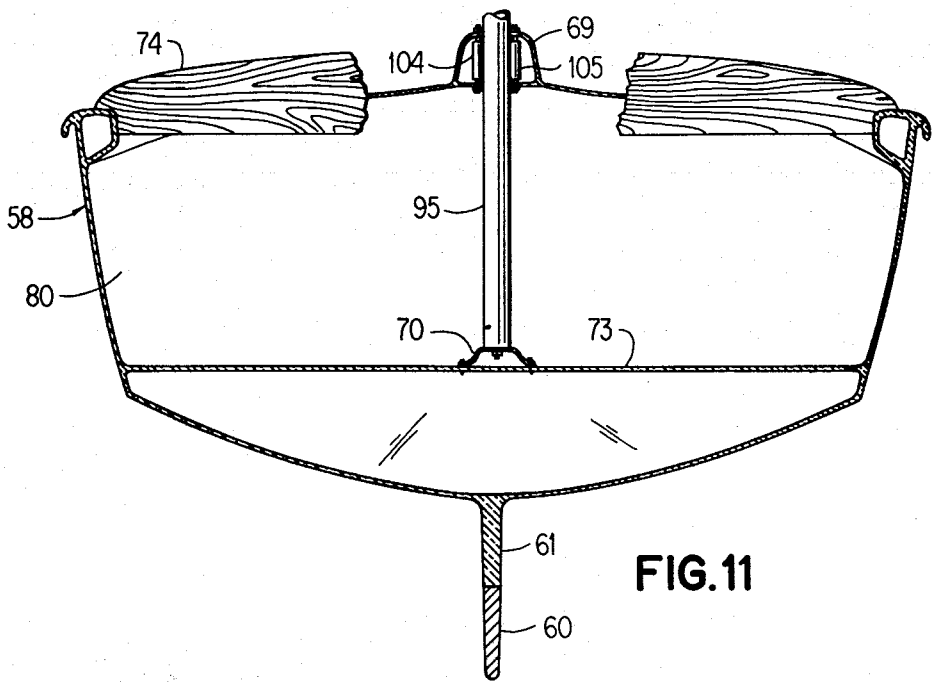
FIG. 11
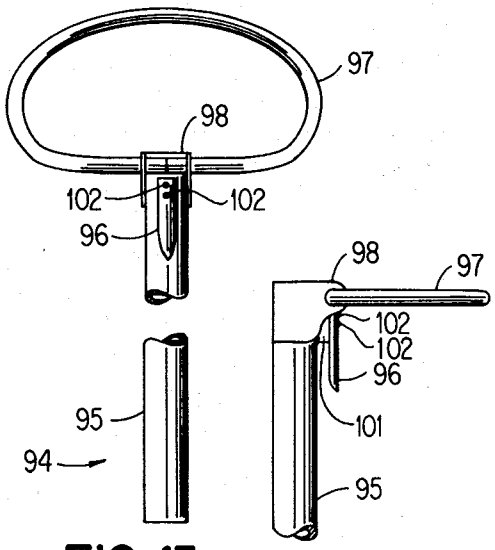
FIG. 13
FIG. 14

SIMPLIFIED SAILING SYSTEM

This invention relates to sailing and more particularly to a unique boat, a unique basic rig and a unique simplified sailing system.

Many problems exist in the art of sailing, especially for the novice sailor or small child. The present inventions solve many of those problems and enable even the novice or small child to enjoy sailing comfortably and safely.

A unique boat, a unique basic rig and a unique simplified sailing system are disclosed herein.

An object of this invention is to provide a simplified sailing system which can be utilized by any sailor, even a novice or small child, to enable easy handling of a sailing boat.

Another object of this invention is to provide a unique basic rig which is balanced and eliminates the need for sheet lines in the jib and mainsail sections of the rig assembly.

A further object of this invention is to provide a basic rig which is balanced and which has equal sailing capabilities regardless of the side direction of the wind.

Still another object of this invention is to maintain the center of effort near the center line of a boat on all direction points of sailing for better efficiency and stability.

Another object of this invention is to maintain the center of effort near the middle of a boat in order to be able to sail the boat easily both forward and backward.

A further object of this invention is to provide a rig assembly which can prevent accidental jibes and unsafe conditions by eliminating sheet lines and enabling the sailor to immediately release the pressure on the sails, even if the wind conditions are unfavorable.

Another object of this invention is to have a balanced rig which is efficient and which utilizes two (2) sails in order to have a slotted effect for better efficiency.

Still another object of this invention is to provide a boat with unique configurations that can utilize the basic rig invention and the simplified sailing system disclosed herein.

These and other objects and features of the invention will be apparent from the following description and appended claims.

Briefly, the invention is to a unique boat, a unique basic rig and a unique simplified sailing system. The basic rig for a plurality of sails for a wind-propelled vehicle comprises a framed support structure operative to hold the plurality of sails. The framed support structure is secured to a rotatable support member. The framed support structure comprises a plurality of spreader sections and a plurality of wishbone members. There is one wishbone member for each of the plurality of sails. A plurality of spreader braces is secured to the rotatable support member. Each of the plurality of spreader braces is secured to one of the plurality of spreader sections and to one or more of the plurality of wishbone members.

The framed support structure further comprises a plurality of connecting means operative to secure the plurality of spreader sections to the rotatable support member. The plurality of connecting means connects the various other parts of the framed support structure together.

The framed support structure may comprise two spreader sections and two wishbone members. The plurality of sails may comprise a mainsail and a jib. The mainsail is secured within one of the two wishbone members. The jib is secured within the other of the two wishbone members.

The two wishbone members may each comprise two wishbone sections. A plurality of spreader braces may secure the two wishbone members to the two spreader sections. A sail attachment means is secured at a high position on the rotatable support member and is operative to support the upper portions of the mainsail and the jib.

A slot adjustment assembly is secured to the rotatable support member. The slot adjustment assembly is operative to adjust the lateral distance between the luff of the mainsail and the leech of the jib when the lower portion of said jib are secured to the lower portion of the rotatable support member through the slot adjustment assembly.

A rig positioning handle is operative to control the rotating movement of the rotatable support member. A rotatable support member base is operative to hold the rotatable support member erect. The rotatable support member base comprises a sleeve, an upper support assembly, and a lower support assembly. The upper support assembly comprises a plurality of rollers placed in a circular configuration slightly larger than the circumference of the sleeve.

The basic rig further comprises a lower jib downhaul and an upper jib downhaul. The lower jib downhaul is connected to the jib and is operative to adjust the tension of the lower jib portion in order to adjust the draft of the jib. The upper jib downhaul is connected to the jib and is operative to adjust the tension of the upper jib portion in order to adjust the draft of the jib.

The unique simplified sailing system is a method and device for sailing a wind-propelled vehicle. The method comprises locating the wind direction by use of wind indication means, placing a wind indicator on the wind indication means, and securing a first coded structure to the wind-propelled vehicle. The method further comprises rigging a plurality of sails on a rotatable support member and placing a rig positioning indicator secured to the rotatable support member. A second coded structure with the same identifiable code thereon is secured to the wind-propelled vehicle. The second coded structure has the same identifiable code as the first coded structure.

The method comprises moving the rotatable support member so that the rig positioning indicator identifies the same portion of the identifiable code on the second coded structure when the wind indicator identifies a similar portion of the identifiable code on the first structure. The rig positioning indicator identifies the same portion of the identifiable code on the second coded structure that the wind indicator identifies on the first coded structure when the sails are in the appropriate position for that particular wind direction.

The identifiable code may be coded by the use of numbers. The identifiable code may be coded by the use of colors.

The first coded structure may be a base for the wind indicator. The second coded structure may be an upper mast support assembly. The rotatable support member may be mounted through the upper mast support assembly. The identifiable code may be visibly secured to the first coded structure and the second coded structure. The wind indicator may comprise a wind indicator pointer. The rig positioning indicator may comprise a rig positioning pointer.

When the wind indicator pointer points to a portion of the identifiable code on the first coded structure, the rig positioning pointer must point to the same portion of the identifiable code on the second coded structure for the sails to be in the appropriate position for that particular wind direction.

The wind indication means comprises a vane rotatably supported on the wind-propelled vehicle. The device for the simplified sailing system comprises wind indication means rotatably supported on the wind-propelled vehicle and operative for locating the wind direction. A wind indicator is secured to the wind indication means. A first coded structure is secured to the wind-propelled vehicle. An identifiable code responsive to the wind indicator is on the first coded structure. A rotatable support member is secured to the wind-propelled vehicle and is operative to support a plurality of sails. A rig positioning indicator is secured to the rotatable support member. A second coded structure is secured to the wind-propelled vehicle. A second coded structure has the same identifiable code as the first coded structure.

The sailing system may be utilized with a plurality of sails or with just one sail, if desired.

When reaching and running, the mainsail does not block the wind from the jib due to the jib swinging automatically into the clear wind.

The invention will be more fully understood from the following detailed description and appended claims when taken with the drawings in which:

Figure 4:
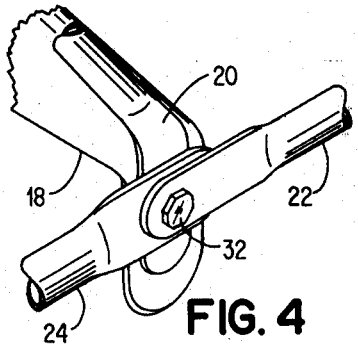

FIG. 4 is a partial isometric view of the right jib wishbone section 22 and the right mainsail wishbone section 24 secured to the spreader brace 20.

Figure 5:
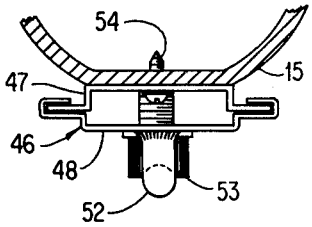

FIG. 5 is a top elevational view showing a partial sectional view of mast 15 with slot adjustment assembly 46 secured therein.

Figure 6:
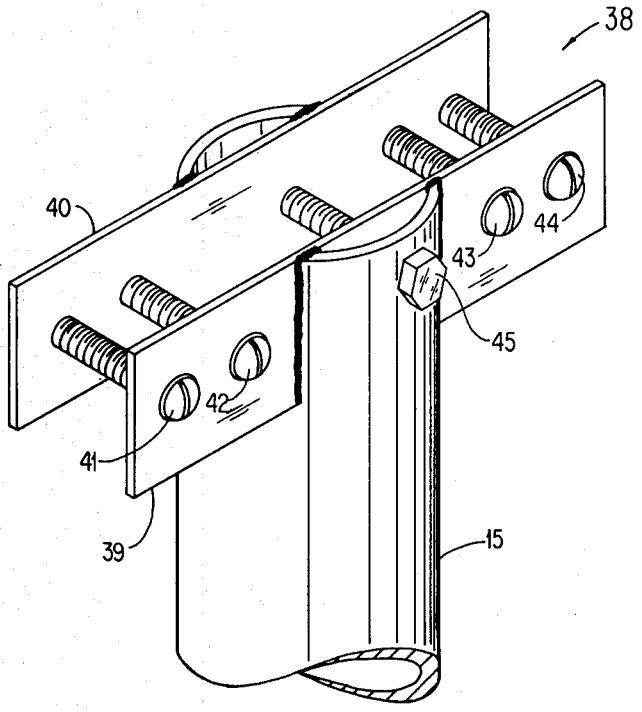

FIG. 6 is an isometric view showing sail attachment means 38 secured onto the top of mast 15.

Figure 7:
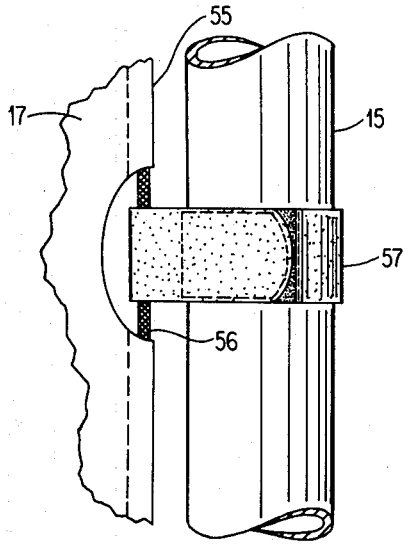

FIG. 7 is a partial elevational view showing attachment means 57 securing the luff of the mainsail 17 to the mast 15.

Figure 8:
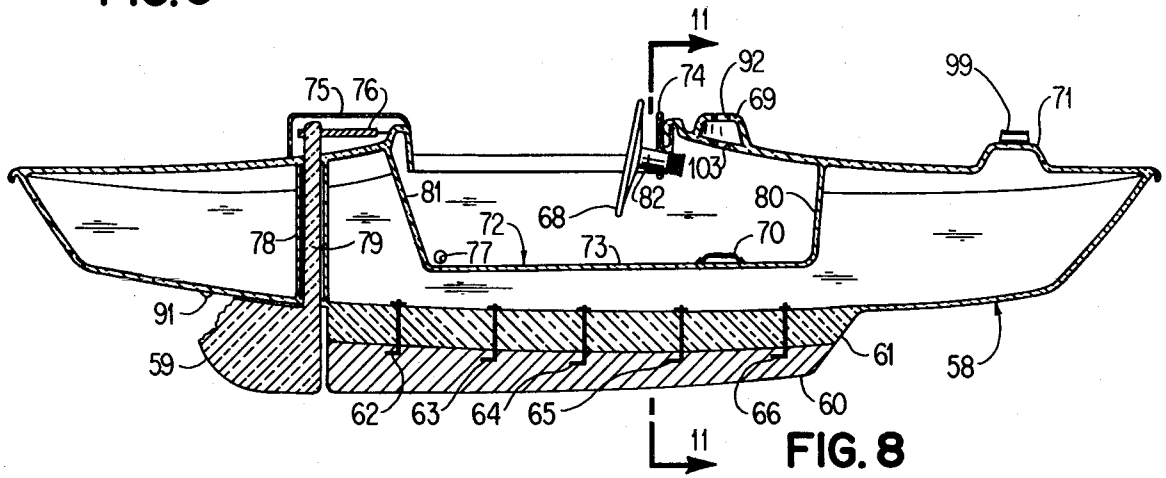

FIG. 8 is a longitudinal sectional view of a unique boat configuration for utilization with the basic rig invention.

Figure 9:
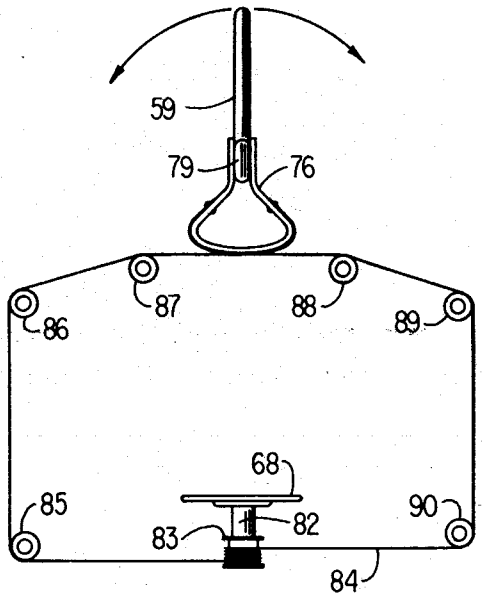

FIG. 9 is a schematic view of the steering system of boat 58 showing the arc swing of rudder 59.

Figure 10:
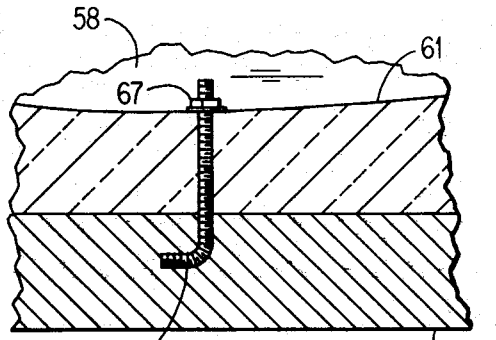

FIG. 10 is an enlarged partial sectional view of the keel of boat 58 showing ballast attachment means 62.

FIG. 11 is a cross-sectional view of boat 58 at Section 11—11 of FIG. 8 with sleeve 95 inserted.

FIG. 12 is an enlarged sectional view of the upper mast support assembly of boat 58.

FIG. 13 is a front elevational view of the rig positioning assembly 94 of boat 58.

FIG. 14 is a side elevational view of the rig positioning assembly 94 shown in FIG. 13.

Figure 15:
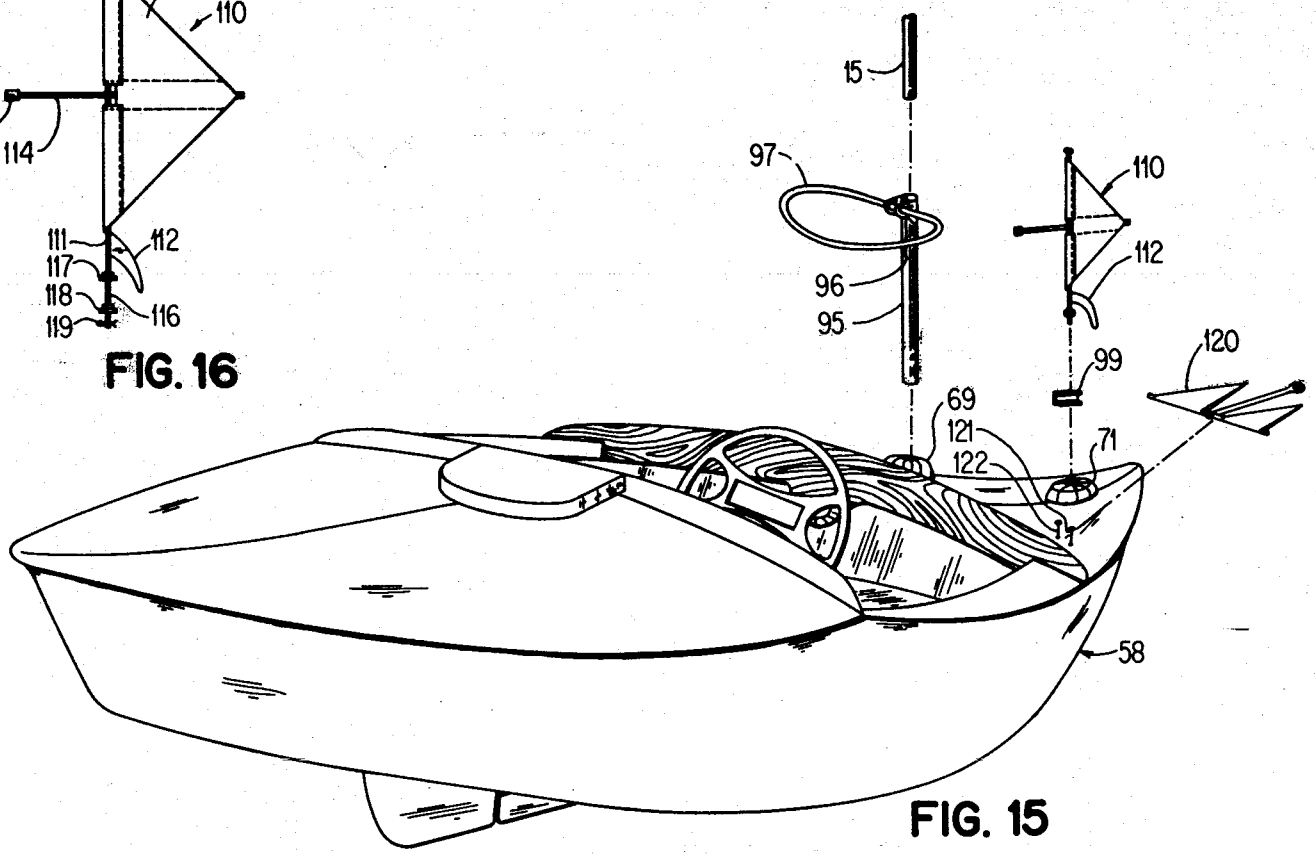

FIG. 15 is an angular elevational view showing the rig positioning assembly 94, the anchor 120, and the wind indication means 110 exploded from the boat 58.

Figure 16:
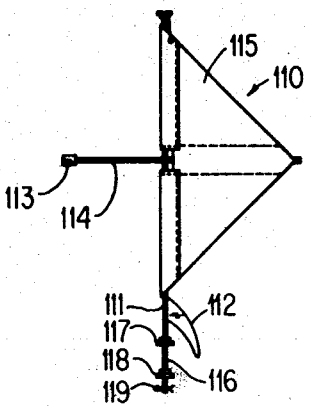

FIG. 16 is an elevational view of the wind indication means 110.

Figure 17:
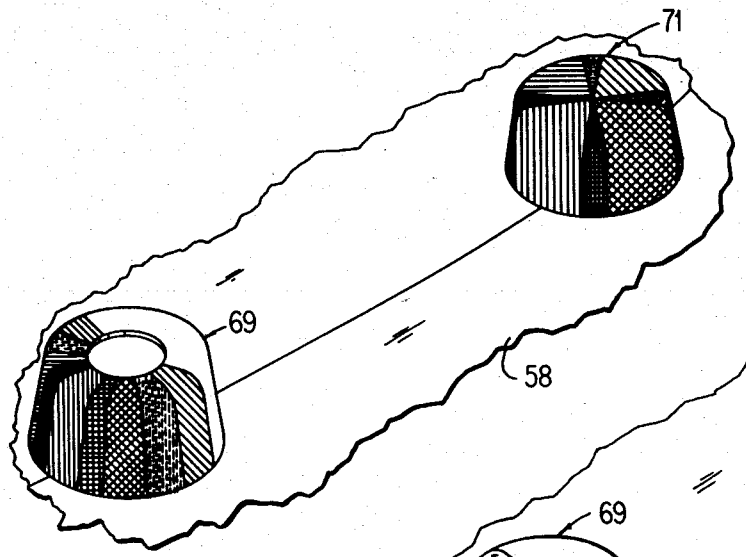

FIG. 17 is a schematic view of the set of bases used for the wind indication means 110 and the rig positioning assembly 94, coded together by color.

Figure 18:
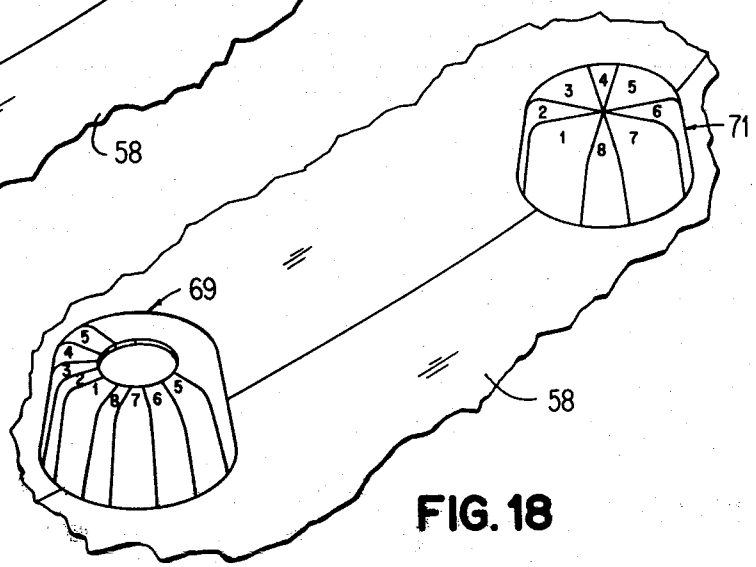

FIG. 18 is a schematic view of the set of bases used for the wind indication means 110 and the rig positioning assembly 94, coded together by numbers.

Figure 19:
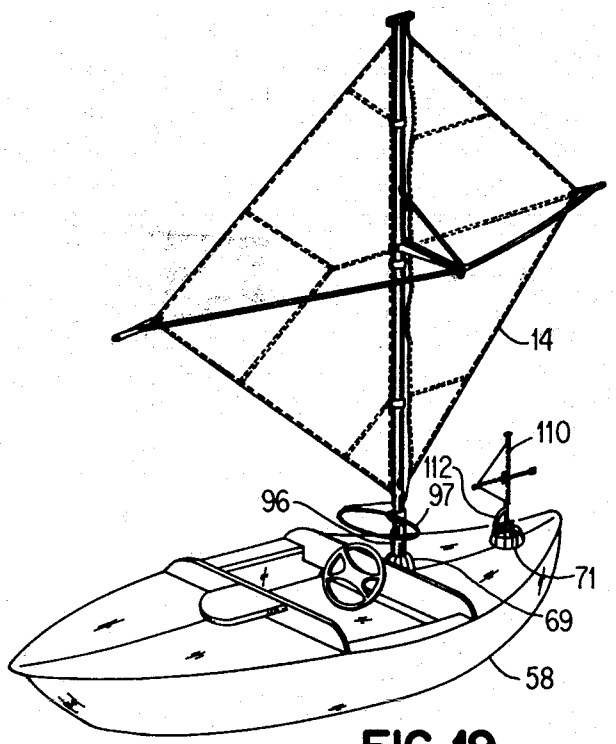

FIG. 19 is an isometric view of the basic rig invention on boat 58 utilizing the simplified sailing system with the wind indicator pointer 112 showing the wind direction and the rig positioning pointer 96 placed in a position for the basic rig assembly to sail to perform with maximum efficiency.

Figure 20:
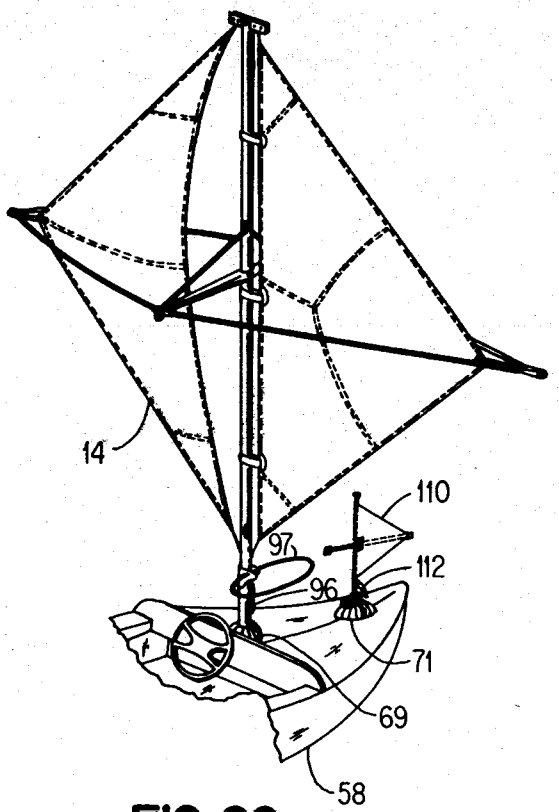

FIG. 20 is a figure similar to FIG. 19 but under different wind direction conditions showing an isometric view of the basic rig invention on boat 58 utilizing the simplified sailing system with the wind indicator pointer 112 showing the wind direction and the rig positioning pointer 96 placed in a position for the basic rig assembly to sail to perform with maximum efficiency.

Figure 1:
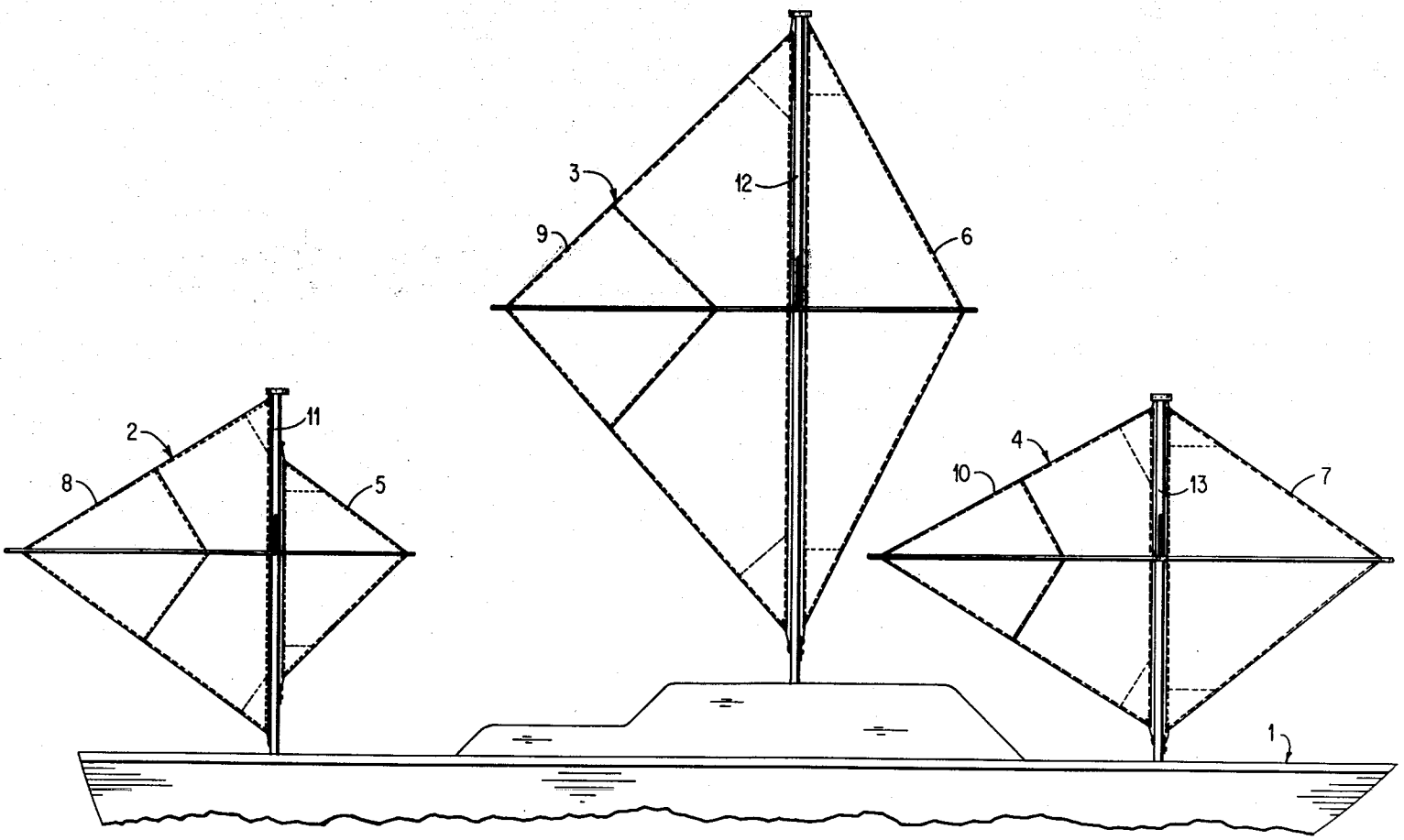
FIG. 1 is a side elevational view showing the top of boat 1 with three (3) rig designs showing various aspect ratios of the basic rig invention.

Referring now to the drawings, FIG. 1 is a side elevational view of the top of boat 1 with three (3) different rig designs showing various aspect ratios of the rig invention.

Boat 1 would not necessarily have three (3) different rig designs on it; however, the different rig designs are shown on boat 1 for illustration. The three (3) rig designs are shown in rig assembly 2, rig assembly 3, and rig assembly 4.

Rig assembly 2 has a jib 5. Rig assembly 3 has a jib 6. Rig assembly 4 has a jib 7. Rig assembly 2 has a mainsail 8. Rig assembly 3 has a mainsail 9, and rig assembly 4 has a mainsail 10. Rig assembly 2 has a mast 11. Rig assembly 3 has a mast 12. Rig assembly 4 has a mast 13.

The various aspect ratios shown in rig assemblies 2, 3, and 4 simply illustrate that the present invention can be used with any ratio of height to width of the desired sail. The different aspect ratio may be decided upon by the design of the boat or as desired by the boat owner. Any combination of widths or heights can be utilized in the present basic rig invention and are included within the scope of this invention.

The basic rig invention may be utilized on any desired boat as a single rig assembly or any number or combination of rig assemblies with the same or different aspect ratios may be used on a boat, as desired.

While the basic rig invention is shown primarily for a boat, it could also be utilized for any type of wind-propelled vehicle including a boat, an ice vehicle, a land vehicle or any other wind-propelled vehicle.

Figure 2:
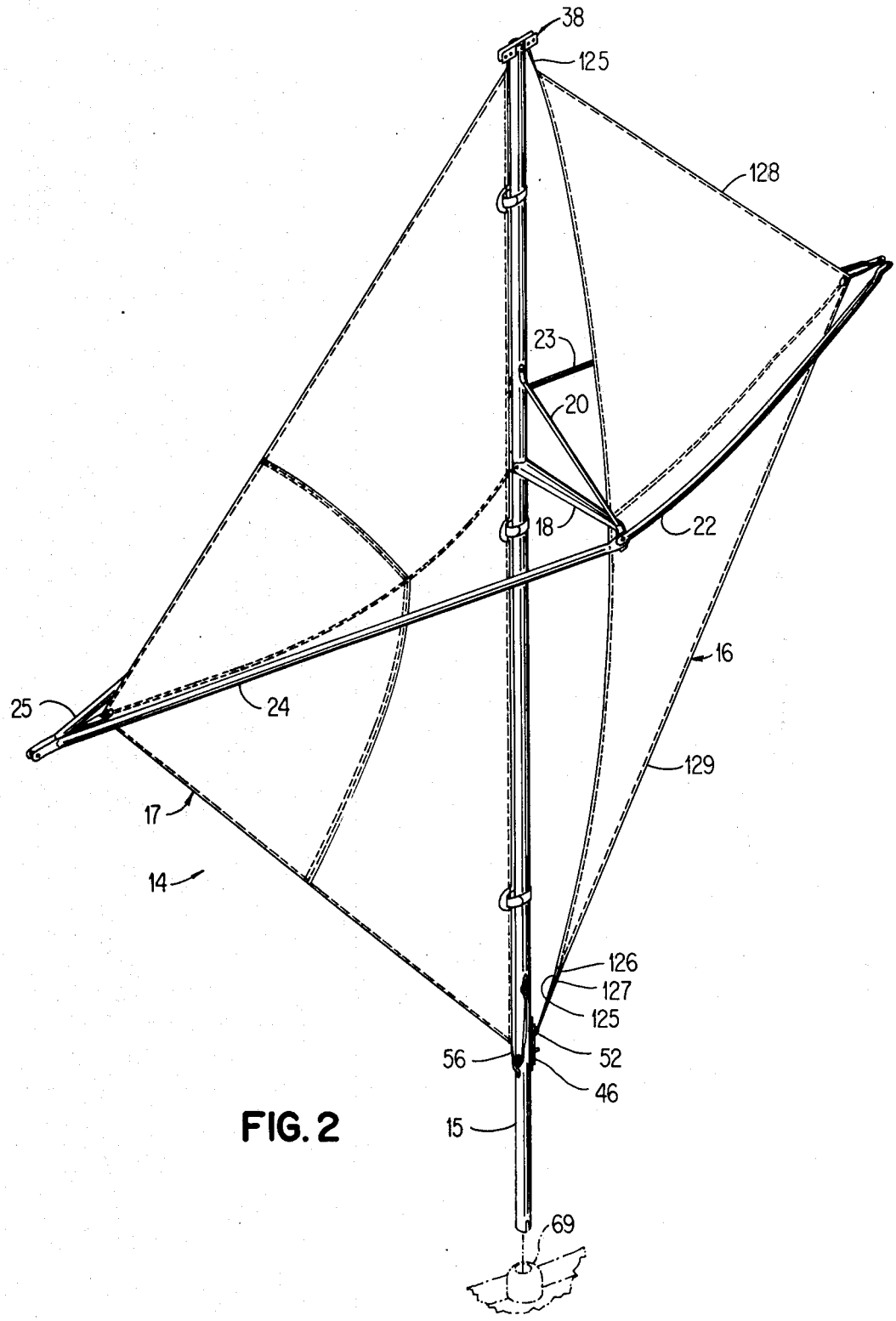
FIG. 2 is an isometric view of the basic rig invention.

FIG. 2 is an isometric view of the basic rig invention. The basic rig invention is shown as rig assembly 14. Rig assembly 14 has a mast 15, a jib 16 and a mainsail 17.

Extending from the mast 15 is a right spreader section 18. Spreader brace 20 extends from right spreader section 18 to mast 15. Right jib wishbone section 22 is connected to the intersection of spreader brace 20, right spreader section 18 and right mainsail wishbone section 24. Right mainsail wishbone section 24 is connected to left mainsail wishbone section 25. Right jib wishbone section 22 is connected to left wishbone section 23.

The slot adjustment assembly 46, more fully shown on FIG. 5, is utilized to adjust the slot between the mainsail 17 and the trailing or after edge of jib 16. The trailing or after edge of jib 16 is herein referred to as being the leech of jib 16. The luff of the mainsail 17 is defined as the forward or leading edge of the mainsail 17, as desired by the sailor utilizing the rig assembly 14. The lateral distance between the luff of the mainsail 17 and the leech of jib 16 is herein defined to be called the slot of the rig assembly 14.

The luff wire 125 and the lower jib downhaul 126 extend from the bottom of jib 16 and pass through eye 52 of slot adjustment assembly 46. The luff wire 125 is utilized to support the luff of the jib 16. The luff is defined as the leading edge of jib 16. Luff wire 125 is normally secured onto cleat 50, and more fully shown on FIG. 3.

Lower jib downhaul 126 is utilized to adjust the tension of the lower jib luff 129 in order to adjust the draft of jib 16. The draft of jib 16 is defined as the curvature of jib 16.

The luff wire 125 and the lower jib downhaul 126 may be secured to the same cleat 50 or may have different cleats, as desired.

Also secured to cleat 50 is the upper jib downhaul 127. The upper jib downhaul 127 passes through the eye 52 of slot adjustment assembly 46 and is then secured to cleat 50. The lower jib downhaul 126 adjusts the lower luff 129 of jib 16. The upper jib downhaul 127 adjusts the upper luff 128 of jib 16. The lower jib downhaul 126 and the upper jib downhaul 127 are utilized to change the draft of jib 16.

Figure 3:
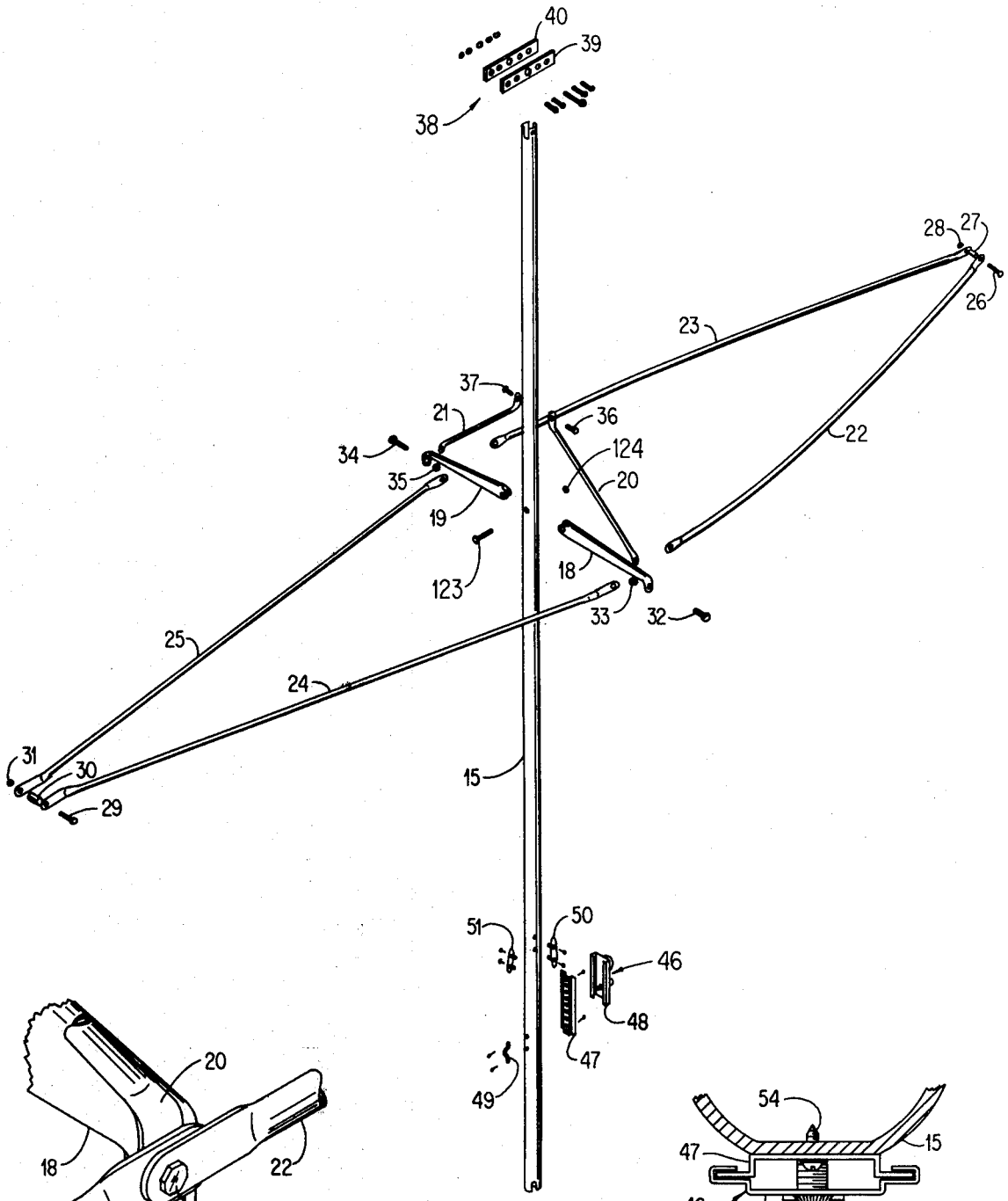
FIG. 3 is an exploded isometric view of the basic rig invention without sails.

The luff wire 56 of mainsail 17 may be secured through luff wire attachment 49 to cleat 51, shown on FIG. 3.

FIG. 3 is an exploded isometric view of the basic rig invention without sails.

Extending from the mast 15 is a right spreader section 18 and a left spreader section 19. Spreader brace 20 extends from right spreader section 18 to mast 15. Spreader brace 21 extends from left spreader section 19 to mast 15. Right jib wishbone section 22 is connected to the intersection of spreader brace 20 and right spreader section 18. Left jib wishbone section 23 is connected to the intersection of spreader brace 21 and left spreader section 19. Right jib wishbone section 22 and left jib wishbone section 23 are joined by bolt 26, spacer 27, and nut 28. If desired, one continuous wishbone section can be made including the functions of right jib wishbone section 22 and left jib wishbone section 23.

Right mainsail wishbone section 24 is connected to the intersection of right spreader section 18 and spreader brace 20. Left mainsail wishbone section 25 is connected to the intersection of left spreader section 19 and spreader brace 21. Right mainsail wishbone section 24 and left mainsail wishbone section 25 are secured together by bolt 29, spacer 30, and nut 31.

The intersection of right spreader section 18, spreader brace 20, right jib wishbone section 22 and right mainsail wishbone section 24 is secured by bolt 32 and nut 33.

Left spreader section 19, spreader brace 21, left jib wishbone section 23, and left mainsail wishbone section 25 are connected by bolt 34 and nut 35.

Spreader brace 20 is connected to mast 15 by screw 36. Spreader brace 21 is connected to mast 15 by screw 37.

Bolt 123 and nut 124 secure right spreader section 18 and left spreader section 19 to mast 15.

FIG. 4 is a partial isometric view of the right jib wishbone section 22 and the right mainsail wishbone section 24 secured to the spreader brace 20.

Bolt 13 is shown extending through right jib wishbone section 22, right mainsail wishbone section 24, spreader brace 20, and right spreader section 18.

FIG. 5 is a top elevational view showing a partial sectional view of mast 15 with the slot adjustment assembly 46 secured therein. The slot of jib 16 is varied by the position of the slot adjustment assembly 46.

Slide 48 moves along track 47. Slide adjustment knob 53 can be loosened to allow the slide 48 to move freely or can be tightened to secure the slide 48 in the desired position on the track 47.

Track attachment screw 54 attaches the slot adjustment assembly 46 to the mast 15. Other securing means for the same purpose may be utilized, as desired.

The luff wire 125 and the lower jib downhaul 126, on FIG. 2, pass through eye 52 of slot adjustment assembly 46.

FIG. 6 is an isometric view of sail attachment means 38 secured onto the top of mast 15. Sail attachment means 38 has a right member 39 and a left member 40. Securing bolts 41, 42, 43, and 44 secure right member 39 to left member 40. Mast attachment bolt 45 extends through mast 15, right member 39, and left member 40 to secure the sail attachment means 38 to mast 15.

The luff wire 56 for the mainsail 17 can be secured on securing bolts 41 and 42 in the area between right member 39 and left member 40. The luff wire 125 may be secured on securing bolts 43 and 44 in the area between right member 39 and left member 40.

Any lines which are desired to be secured to the upper part may be secured onto the sail attachment means 38. Sail attachment means 38 can be designed as shown in FIG. 6 or can be any other configuration which would perform the same function.

FIG. 7 is a partial elevational view showing attachment means 57 securing the luff 55 of the mainsail 17 to the mast 15. Velcro attachment means 57 is shown securing the luff 55 of the mainsail 17 to the mast 15. Luff wire 56 secures the luff 55 of mainsail 17. The luff wire 56 passes through the velcro attachment means 57. The velcro attachment means 57 is simply illustrative of one type of attachment means which could be utilized. Any type of attachment means which will perform the same function can be utilized.

FIG. 8 is a longitudinal sectional view of a unique boat configuration for utilization with the basic rig invention.

Boat 58 has a rudder 59. The keel of boat 58 has a lower section of ballast 60 and a keel upper section 61. The ballast 60 is secured to the keel upper section 61 by ballast attachment means 62, 63, 64, 65, and 66. The ballast attachment means shown are keel bolts.

Boat 58 has a steering wheel 68, an upper mast support assembly 69, a lower mast support assembly 70 and wind indication means base 71.

The boat 58 has a cockpit 72. The cockpit 72 has a floor 73 with a scrupper 77 for drainage purposes and another scrupper (not shown).

The boat 58 has a coaming or splash board 74 for keeping water out of the cockpit 72. The boat has a steering quadrant cover 75 for the steering quadrant 76. The steering quadrant 76 is connected by steering cable 84 to steer the boat 58. The boat 58 has a rudder extension sleeved opening 78 for the rudder extension 79.

FIG. 9 is a schematic view of the steering system of boat 58 showing the arc swing of rudder 59.

The steering wheel 68 is connected to the steering column 82 on which is secured a steering cable drum 83.

The steering cable 84 extends through steering cable pulleys 85, 86 87, 88, 89, and 90 and back to the steering cable drum 83. The steering cable 84 is secured to the steering quadrant 76 is order for the steering wheel 68 to control the movements of rudder 59.

The boat 58 has rudder stops on both sides of the boat 58 in order to control the arc swing of the rudder 59. Left rudder stop 91 and a right rudder stop (not shown) are utilized to restrict the movement of rudder 59.

The boat 58 has a forward watertight bulkhead 80 and a rear watertight bulkhead 81 to form the cockpit 72 along with the right and left sides of boat 58.

If water enters the cockpit 72, the cockpit is self-draining due to the position of the scrupper 77 and the scrupper (not shown).

FIG. 10 is an enlarged partial sectional view of the keel of boat 58 showing ballast attachment means 62. Ballast attachments 62 is secured within keel lower section 60 and passes through keel upper section 61.

Nut 67 secures ballast attachment means 62 to the boat 58. Nuts similar to 67, but not shown, secure the other ballast attachment means 63, 64, 65, and 66 to boat 58. Any type of ballast attachment means can be utilized, as desired, to perform the same function.

FIG. 11 is a cross-sectional view of boat 58 and section 11—11 of FIG. 8 with mast sleeve 95 inserted. The mast sleeve 95 is inserted into the lower mast support assembly 70. The upper mast support assembly 69 contains a plurality of rollers such as rollers 104 and 105 which enable the mast sleeve 95 to move in a circular direction 360°, if desired.

FIG. 12 is an enlarged sectional view of the upper mast support assembly of boat 58. The sleeve opening 92 in the upper mast support assembly 69 allows the mast sleeve assembly 95 to be placed into the lower mast support assembly 70.

Below the plurality of rollers including roller 104 and 105 is a sleeve opening 103 which is similar to sleeve opening 92. Each roller is secured within the upper mast support assembly 69 by a bolt and a nut. Bolt 106 and nut 108 secure roller 104. Bolt 107 and nut 109 secure roller 105. For the purpose of the basic rig invention, any mast support assembly which allows free circular movement of the mast 15 would be sufficient.

FIG. 13 is a front elevational view of the rig positioning assembly 94 of boat 58. The mast sleeve 95 is connected to the rig positioning handle 97 by bracket 98. Bracket 98 fits around the end of mast sleeve 95 and is secured by welding or some other desired means. Rig positioning handle 97 may be secured as shown to the mast sleeve 95 or it may be secured directly to the mast 15, if desired.

Mounting bracket 101 is attached to the mast sleeve 95 and holds the rig positioning pointer 96. The rig positioning handle 97 may be moved in a lateral direction, if desired, and also may be swung up or down pivoting on its connection at bracket 98.

FIG. 14 is a side elevational view of the right positioning assembly 94 shown in FIG. 13. In FIG. 14, rig positioning handle 97 has been pivoted down to a different position than was shown in FIG. 13.

Securing screws 102 for rig positioning pointer 96 are shown connected into mounting brackt 101 for rig positioning pointer 96.

FIG. 15 is an angular elevational view showing the rig positioning assembly 94, the anchor 120 and the wind indication means 110 exploded from the boat 58. Boat 58 has a wind indicator mounting support bracket 99. Anchor 120 may be secured onto the boat 58 by anchor brackets 121 and 122.

FIG. 16 is an elevational view of wind indication means 110 which fits into wind indicator mounting support bracket 99. Wind indication means 110 has a mast 116 and a vane 115.

Counterbalance 113 is connected to the mast 116 by counterbalance rod 114. Nylon bushings 117 and 118 serve to allow the wind indication means 110 to turn freely within wind indicator mounting support bracket 99.

Mast sleeve 111 fits over mast 116. Vane 115 is connected to mast sleeve 111. Wind indicator pointer 112 is rigidly secured to the mast sleeve 111.

FIG. 17 is a schematic view of the set of bases used for the wind indication means 110 and the rig positioning assembly 94, coded together by colors.

When the wind indicator pointer 112 shows the wind direction, if the rig positioning pointer 96 is placed in position to be on the same color that the wind indicator pointer 112 is on, the boat 58 will sail with maximum efficiency.

FIG. 18 is a schematic view of the set of bases used for the wind indication means 110 and the rig positioning assembly 94, coded together by numbers. If the wind indicator pointer 96 is placed on the same number, then the basic rig assembly 14 will perform to sail the boat 58 with maximum efficiency.

In FIG. 17, whatever color the wind indicator pointer 112 is on is the color that the rig positioning pointer 96 should be on.

In FIG. 18, whatever number the wind indicator pointer 112 is on is the number that the rig positioning pointer 96 is on.

Any type of codes may be utilized for the simplified sailing system invention. The code with numbers or the code with colors can be easily utilized by any sailor, even if it is a novice sailor or small child.

FIG. 19 is an isometric view of the basic rig invention placed on boat 58 utilizing the simplified sailing system with the wind indicator pointer 112 showing the wind direction and the rig positioning pointer 96 placed in a position for the basic rig assembly to sail to perform with maximum efficiency.

FIG. 20 is a figure similar to FIG. 19, but under different wind conditions, showing an isometric view of the basic rig invention on boat 58 utilizing the simplified sailing system with the wind indicator pointer 112 showing the wind direction and the rig positioning pointer 96 placed in a position for the basic rig assembly to sail to perform with maximum efficiency.

This specification discloses a basic rig invention, a simplified sailing system invention and a unique boat that may utilize both the basic rig invention and the simplified sailing system invention. The design of the basic rig invention has many features which are advantageous to the rig owner.

The present invention enables the mast to turn 360°. No supporting wires are utilized with the basic rig invention. Supporting wires would and do interfere with a 360° turn.

The mast is mounted in a mount utilizing rollers so that the mast will turn easily. The rig is designed so that the sail does not twist. A twisting sail would be very inefficient. The rig is designed so that as soon as the rig is released and the sail is free, the sail will automatically weather vane. In other words, the sail will turn into the wind and there will be no danger of capsizing the boat or putting any unnecessary strain on the rigging.

The rig is designed to prevent accidental jibing. The sailor only needs to release the rig and the boat will come to a stop.

In this particular invention, the center of effort is so close to the mast that the boat can easily be sailed forward and backwards.

The wishbone that supports the jib may be curved in such a manner that it will control the sail in a proper airfoil shape when it blows out and touches the wishbone. The curve of the wishbone may vary for different types of boats.

The present rig is very efficient. Two sails are utilized, a mainsail and a jib. A slot effect for control exists between the jib and the mainsail. The present rig is a balanced rig. The slot effect increases the efficiency of the sails.

The simplified sailing system can be utilized for people who have never sailed before. The safety and efficiency of the present disclosed system enable the beginner to safely and efficiently enjoy sailing. The present rig may be utilized not only on boats, but on model boats or any wind-propelled vehicle.

The objects of the present invention have been met. The present disclosure has a unique boat, a unique basic rig and a unique simplified sailing system. The simplified sailing system can be utilized by any sailor, even a novice or a small child, to enable easy handling of the wind-propelled vehicle. A unique basic rig is balanced and eliminates the need for sheet lines in the jib and mainsail sections of the rig assembly. The basic rig is balanced and has equal sailing capabilities regardless of the side direction of the wind. The center of effort is near the center line of the wind-propelled vehicle on all direction points of sailing for better efficiency and stability. The center of effort is near the middle of the wind-propelled vehicle in order to be able to sail the wind-propelled vehicle easily forward and backward.

The rig assembly can prevent accidental jibes and unsafe conditions by eliminating the sheet lines and enabling the sailor to immediately release the pressure on the sails, even if the wind conditions are unfavorable.

The balanced rig is efficient and utilizes two sails in order to have a slotted effect for better efficiency. The wind-propelled vehicle has a unique configuration that can utilize the basic rig invention and the simplified sailing system.

The rotatable support member can be the mast, or in the case of a rigging involving a boom which extends from the mast, the rotatable support member could be the boom which would rotate around the mast.

A rig positioning indicator can be secured to the boom or the mast, whichever is the rotatable support member. Some other rotatable support member could be secured on the wind-propelled vehicle or to some structure on the wind-propelled vehicle to perform the function of the rotatable support member.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A method for sailing a wind-propelled vehicle comprising:

(a) providing means for maintaining knowledge of the appropriate wind direction sufficient to enable a novice to make appropriate positioning of a rig to safely operate said vehicle, including, a wind indication means rotatably supported on said wind propelled vehicle and operative for locating the wind direction, a wind indicator secured to said wind indication means, a first coded structure secured to said wind-propelled vehicle, with an identifiable code responsive to said wind indicator, a rotatable support member secured onto said wind-propelled vehicle and operative to support a plurality of sails, a rig positioning indicator secured to said rotatable support member, and a second coded structure secured to said wind-propelled vehicle, with the same said identifiable code thereon responsive to said rig positioning indicator;

(b) locating the wind direction by use of said wind indication means secured to said surface of said wind-propelled vehicle;

(c) placing said wind indicator on said wind indication means;

(d) securing to said wind-propelled vehicle said first coded structure around the base of said wind indication means, with said identifiable code thereon responsive to said wind indicator;

(e) rigging a plurality of sails for said wind-propelled vehicle on said rotatable support member;

(f) placing said rig positioning indicator secured to said rotatable support member;

(g) securing to said wind-propelled vehicle said second coded structure around said rotatable support member, with the same identifiable code thereon responsive to said rig positioning indicator; and (h) moving said rotatable support member so that the rig positioning indicator identifies the same portion of said identifiable code on said second coded structure when said wind indicator identifies a similar portion of said identifiable code on said first coded structure;

whereby, when said rig positioning indicator identifies the same portion of said identifiable code on said second coded structure that said wind indicator identifies on said first coded structure, said plurality of sails are in the appropriate position for that particular wind direction.

2. A method according to claim 1 wherein said identifiable code is coded by the use of numbers.

3. A method according to claim 1 wherein said identifiable code is coded by the use of colors.

4. A method according to claim 1 wherein said first coded structure is a base for said wind indicator and said second coded structure is an upper mast support assembly.

5. A method according to claim 4 wherein said rotatable support member is mounted through said upper mast support assembly.

6. A method according to claim 1 wherein said identifiable code is visibly secured onto said first coded structure and said second coded structure.

7. A method according to claim 6 wherein said wind indicator comprises a wind indicator pointer and said rig positioning indicator comprises a rig positioning pointer whereby, when said wind indicator pointer points to a portion of said identifiable code on said first coded structure, said rig positioning pointer must point to the same portion of said identifiable code on said second coded structure for the plurality of sails to be in the appropriate position for that particular wind direction.

8. A method according to claim 1 wherein said wind indication means comprises a vane rotatably supported on said wind-propelled vehicle.

9. A device for sailing a wind-propelled vehicle comprising means for maintaining knowledge of the appropriate wind direction sufficient to enable a novice to make appropriate positioning of a rig to safely operate said vehicle, including:

(a) a wind indication means rotatably supported on said wind-propelled vehicle and operative for locating the wind direction;

(b) a wind indicator secured to said wind indication means;

(c) a first coded structure secured to said wind-propelled vehicle, with an identifiable code responsive to said wind indicator;

(d) a rotatable support member secured onto said wind-propelled vehicle and operative to support a plurality of sails;

(e) a rig positioning indicator secured to said rotatable support member; and (f) a second coded structure secured to said wind-propelled vehicle, with the same said identifiable code thereon responsive to said rig positioning indicator;

whereby, when said rig positioning indicator identifies the same portion of said identifiable code on said second coded structure that said wind indicator identifies on said first coded structure, said plurality of sails are in the appropriate position for that particular wind direction.

10. A device according to claim 9 wherein said identifiable code is coded by the use of numbers.

11. A device according to claim 9 wherein said identifiable code is coded by the use of colors.

12. A device according to claim 9 wherein said first coded structure is a base for said wind indicator and said second coded structure is an upper mast support assembly.

13. A device according to claim 12 wherein said rotatable support member is mounted through said upper mast support assembly.

14. A device according to claim 9 wherein said identifiable code is visibly secured onto said first coded structure and said second coded structure.

15. A device according to claim 14 wherein said wind indicator comprises a wind indicator pointer and said rig positioning indicator comprises a rig positioning pointer whereby, when said wind indicator pointer points to a portion of said identifiable code on said first coded structure, said rig positioning pointer must point to the same portion of said identifiable code on said second coded structure for the plurality of sails to be in the appropriate position for that particular wind direction.

16. A device according to claim 9 wherein said wind indication means comprises a vane rotatably supported on said wind-propelled vehicle.

* * * * *